US005167264A

United States Patent [19]

Kälin

[11] Patent Number: 5,167,264

[45] Date of Patent: Dec. 1, 1992

[54] RAMIE CONTAINING TEXTILE SUBSTRATE FOR SEAT COVERS

[75] Inventor: Albin Kälin, Widnau, Switzerland

[73] Assignee: Jacob Rohner AG, Rebstein, Switzerland

[21] Appl. No.: 625,168

[22] Filed: Dec. 5, 1990

Related U.S. Application Data

[63] Continuation-in-part of Ser. No. 398,236, Aug. 24, 1989, Pat. No. 5,070,915.

[30] Foreign Application Priority Data

Aug. 5, 1990 [EP] European Pat. Off. ..... 90108623.1

[51] Int. Cl.[5] ..... D03D 15/00

[52] U.S. Cl. ..... 139/420 R; 139/420 A; 139/426 R; 428/225

[58] Field of Search ..... 139/420 R, 427, 426 R, 139/426 TN, 420 A; 428/225, 259, 193; 66/202, 84 A; 297/219, 229

[56] References Cited

U.S. PATENT DOCUMENTS

| | | | |
|---|---|---|---|
| 2,882,933 | 4/1959 | Hindle et al. | 139/426 R |
| 4,067,209 | 1/1978 | Kucera et al. | 66/193 |
| 4,469,739 | 9/1984 | Gretzinger et al. | 139/420 R |
| 4,578,306 | 3/1986 | Heiman | 139/420 R |
| 4,845,960 | 7/1989 | Schnegg | 66/84 A |
| 5,070,915 | 12/1991 | Kalin | 139/420 R |

FOREIGN PATENT DOCUMENTS

| | | | |
|---|---|---|---|
| 342813 | 7/1927 | Belgium | 139/420 R |
| 639856 | 11/1963 | Belgium | 139/420 R |
| 158820 | 2/1983 | Fed. Rep. of Germany | 139/420 R |
| 7037569 | 5/1972 | France | 139/420 R |
| 2490688 | 9/1981 | France | 139/420 R |
| 393214 | 10/1965 | Switzerland | 139/420 R |

*Primary Examiner*—Andrew M. Falik
*Attorney, Agent, or Firm*—EGLI International

[57] ABSTRACT

A textile substrate for seat covers that may be woven or knit fabric, especially weft raschel fabric, or Malimo fabric contains 45 to 65% in weight of natural fibers at least 40% in weight of which is wool and 5 to 25% in weight ramie. It contains 35 to 55% in weight of synthetic fibers such as polypropylene, polyamide, polyacrylic, aramide, and especially polyester. In a woven or knit fabric the warp may consist of synthetic fiber and the weft of a mixture of wool and ramie fiber, or vice versa, or in both warp and weft threads of wool and ramie as well as threads of synthetic fiber may be used.

11 Claims, 2 Drawing Sheets

RAMIE CONTAINING TEXTILE SUBSTRATE FOR SEAT COVERS

This application is a continuation in part of the application Ser. No. 07/398,236 filed on Aug. 24, 1989 now U.S. Pat. No. 5,070,915.

BACKGROUND OF THE INVENTION

1. Field of the Invention

The present invention relates to a textile substrate, which can be processed to form coverings for upholstered furniture, chairs and other seats and in which the substrate has at least one yarn, which is constructed as a mixed yarn having natural fibers.

More particularly, the invention relates to a textile substrate for seat covers that may be woven or knit fabric that contains at least 40% in weight fibers of synthetic material.

2. Description of Related Art

Special demands have been typically made on material layers to be used for seat coverings. The term "seat" is used to define all types thereof, i.e. upholstered furniture, covered chairs, car seats, office chairs, as well as sets in vehicles, such as aircraft and trains, as well as for wheel-chairs for invalids and handicapped.

The demands to be made on such materials are of widely differing types and in part also have opposite tendencies, i.e., an improvements to one characteristic leads to a deterioration of another.

The sitting comfort resulting from such coverings is particularly important when the seat is used for considerable periods, without the user being able to leave it. Such a situation, e.g., occurs with invalids confined to wheel-chairs, the invalid only being able to leave the chair with external aid. A similar situation exists with the driver of a motor vehicle, if he has to cover long distances without being able to interrupt the journey. Similar conditions also exist for aircraft and rail travellers, which involve long periods during which the traveller sits.

Even when sitting, the human body evolves heat, which is given off to the environment. The amount of heat to be dissipated is dependent on the heat resistance of the environment. If this is too high, the body is unable to maintain its heat balance, which leads to perspiration which cools the body. If this perspiration is insignificant and hardly detectable, then it does not lead to discomfort for the person involved. However, in the case of significant perspiration it leads to liquid formation, then the seat feels unpleasant if it is not possible to remove the moisture. The well-being of the person seated for a long time depends both on the clothing and in particular on the seat covering and the heat resistance thereof.

It has been known to use in the clothing field the materials which have a low heat resistance and, therefore, facilitate perspiration of the body to the outside and largely prevent the penetration of wind and rain. Such articles of clothing consist of a laminate, where use is made of two or three layers. One of these layers is a thin membrane of polytetrafluoroethylene (PTFE), which contains microscopically small pores. The small pores of this water-repelling membrane do not permit pentration of water therethrough. However, it is possible for water vapor, such as is produced through the heat evolution of the human body, to diffuse through the pores.

However, such laminates cannot be used for seats, because the water vapor forming on the body reaches the outer surface of the covering and would have to be given off to the environment. However, as substantially all seats have an upholstery comprising plastic inserts and foams, which have a high heat resistance, the water vapor passing through the membrane can only be given off to a minor extent, if at all, to the environment.

A textile substrate in accordance with the category is disclosed in the parent application, Ser. No. 07/398,236 now U.S. Pat. No. 5,070,915. In this reference the content of natural fibers is between 65 and 85% in weight. Such substrates stand out because of their excellent capacity for absorbing and draining water vapor and water, which renders them especially suitable for seat covers of seating equipment used uninterruptedly for long periods of time such as car and aircraft seats, wheelchairs, office chairs, etc., since the good drainage of the water from the surface of the fabric prevents that the seat cover feels moist to the touch and that the seating comfort is impaired.

SUMMARY OF THE INVENTION

It is an object of the present invention to develop an improved substrate of the aforementioned type, in which its heat resistance is kept low and it is possible to achieve an adequate water vapor dissipation to the environment, without impairing the absorptivity and abrasion resistance of the material itself.

Since earlier studies have shown that the capacity of water absorption of the natural fibers, especially of wool, contributes significantly to the mentioned favorable characteristics, one started out assuming that the quantity of such fibers should be relatively high, that is at least 65% in weight, and that with lower contents the absorbency and storage capacity with regard to water would not be sufficient. Even though high synthetic fiber contents are desirable because they offer greater possibilities as regards design, one had settled with the fact that the quoted content must not be higher than 35% in weight.

Surprisingly, further experiments have shown that contents of natural fibers of wool and ramie of between 45 and 65% in weight are as a matter of fact sufficient for guaranteeing the previously mentioned, faborable characteristics of fabrics in accordance with this category.

It has turned out that the content of ramie fibers should be between 5 and 25% in weight and the content of wool should not be lower than 40%.

Hence, the invention permits the production of textile substrates having the desired characteristics in regard to the drainage of moisture and at the same time a relatively high content of synthetic fibers which offers good possibilities as regards design.

In an embodiment, the substrate contains from 45 to 65% by weight of natural fibers of wool and ramie so that said mixed yarn is formed from wool and ramie.

In an embodiment, the synthetic fibers are mixed with the mixed yarn.

In an embodiment, the natural fibers in said mixed yarn are formed from animal and plant fibers.

In an embodiment, the amount of ramie fibers in the mixed yarn is 5 to 25% by weight.

In an embodiment, synthetic fibers of the substrate comprise at least 15% by weight of polyester fibers.

Different embodiments of textile substrates in accordance with the invention can be produced. Substrates where ramie fibers had been added to the wool-containing yarn have turned out to be especially advantageous.

Moreover, it has also turned out as being very favorable in woven or knit fabrics to use warp threads of synthetic material and weft threads of a mixture of wool and ramie fibers, or inversely weft threads of synthetic fibers and warp threads of wool and ramie fibers.

Nevertheless, it is also possible to use substrates containing mixed yarn of wool and ramie and yarn of synthetic fibers in both warp and weft.

From among the synthetic materials the kinds best suited are polyester, polypropylene, polyamide, polyacrylic and aramide. Polyester has turned out to be particularly well suited.

The textile substrate can be realized in various ways. Besides woven and knit fabrics, especially weft raschel fabrics, also Malimo fabrics are a possibility.

DETAILED DESCRIPTION OF THE PREFERRED EMBODIMENTS

The present invention is based on the idea that the sitting comfort of a seat covering can be improved in that the water vapor produced by the person sitting on the seat is led off within the textile substrate used as the covering and can be given off to the environment.

The textile substrate to be used as a covering for the sitting and back parts of seats must be very hardwearing, because such materials must be usable for a very long period. This is more particularly required in public transport vehicles, such as aircraft and trains. It is known that materials woven with plastic yarns are very hardwearing. Admittedly, as a result of a plastic yarn the moisture formed on the body is rapidly passed on, but such a yarn cannot absorb and store moisture. This means that even when small moisture quantities are present, the impression is given that the material is moist. This is considered unpleasant by the sear user and is, therefore, evaluated as inadequate sitting comfort.

It is also known that wool has a high moisture absorptivity, so that a wool covering offers pleasant sitting comfort for as long as the absorptivity limit is reached. However, wool is a very poor moisture conductor, so that when a material formed from a wool yarn is used for a long time, a considerable sitting comfort reduction must be expected as soon as the moisture absorptivity is exhausted.

In order to improve the undesired characteristics of plastic and wool, coverings were produced in which the material was woven from a synthetic yarn and a wool yarn.

The textile substrate of the present invention is comprised of at least one mixed yarn of natural fibers. The proportion of natural fibers in the substrate is from 45 to 65% by weight whereas the remainder are synthetic fibers.

Figure 1:
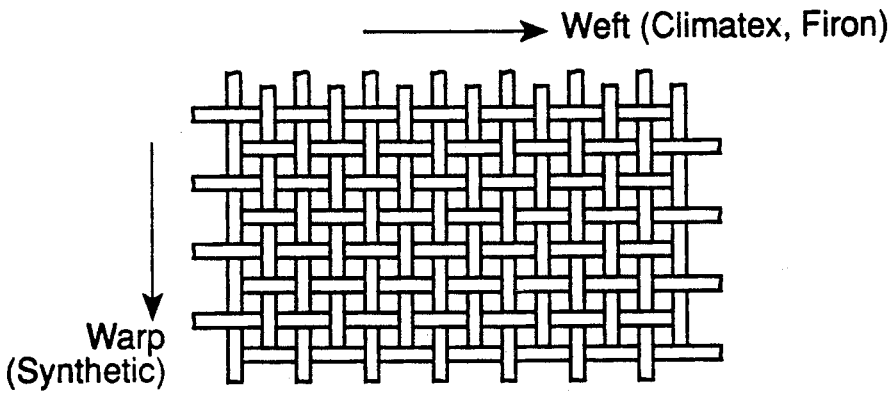
FIG. 1 is a plan view of a substrate with synthetic warp threads and weft threads of Climatex yarn.

For example, a synthetic yarn was used for the warp and a wool yarn for the weft. (FIG. 1) Although seat coverings made from such a material offer a good sitting comfort, this is only within the scope of the characteristics of the wool and the synthetic material, i.e., leading off of moisture and absorptivity in accordance with the wool and synthetics proportions. Even though the use of a synthetic yarn improved the leading off of water vapor, after a relatively short time the seat user experienced a subjectively determinable decrease in the sitting comfort.

Figure 2:
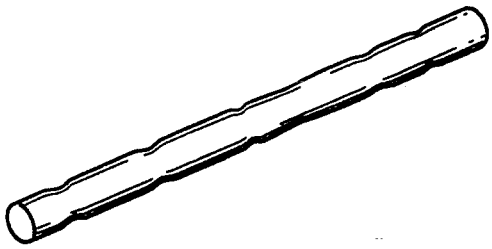
FIG. 2 is a perspective view of a yarn of Climatex or Firon containing blend of wool/ramie in proportion 80 to 20.

Further research for improving the sitting comfort has led to the use of a mixed yarn in place of the wool yarn. Surprisingly the sitting comfort was only improved when using a mixed yarn of wool and ramie (FIG. 2). Ramie is a bast fiber and one of the oldest fibers used for production of textiles. Ramie and a similar plant known as china grass more particularly grow under tropical and subtropical climatic conditions. Under suitable climatic conditions, the perennial ramie plant reaches the height of 120–250 cm. and there can be up to five harvests every year. Ramie fibers cleaned by decortication and degumming largely consist of cellulose and, therefore, behave in much the same way as cotton, but are smoother, stiffer and more lustrous.

Using the aforementioned mixed yarns, it has been possible to produce seat coverings giving a considerably increased sitting comfort.

Comparative tests were performed by the Springborn Laboratories (Europe) AG in CH-9326 Horn. The moisture transport in a fabric union was measured in the transverse and longitudinal direction, in that the height of rise of water was established. The test was based on the use of a covering material, the warp threads of which consisted of a polyester fiber PE/CS under the Tradename "TREVIRA", whereas the weft thread consisted of a woven fabric of the present applicant known under the Trademark "CLIMATEX". The composition of this woven fabric is comprised of 23% polyester PE/CS, 15% ramie RA (fiber with the Trademark name FIRON of Ernest H. Fischers Söhne, CH-5605 Dottikon) and 62% wool WO. The height of rise in the yarn direction after three hours was 19.5 cm and in the weft direction 16.9 cm.

In the case of a comparison material, the warp and weft threads of which consisted of PE/CS, the values of the material after three hours were 20.8 cm in the warp direction and 18.0 cm in the weft direction. Thus, the height of rise for a material made from 100% PE/CS was only slightly higher than that of the material with the mixed yarn "CLIMATEX" used as the weft. The material consisting solely of PE/CS only gives a limited sitting comfort, whereas that with the mixed yarn fulfills very high demands with regards to the sitting comfort. In addition, the tear resistance of the material is increased by using ramie fibers.

It is mentioned for comparison purposes, that in a fabric union, in which the weft and warp threads consisted of 100% wool, the height of rise in both the transverse and longitudinal directions after one and three hours were substantially zero. The aforementioned favorable results can only be obtained with mixed yarns, in which to the natural fibers thereof are added cotton, linen, staple fiber with wool or other animal or synthetic fibers.

The preferred composition for coverings for increasing the sitting comfort of seats is comprised at not lower than 40% wool, 5 to 25% ramie and 40 to 55% polyester.

The polyester fibers in the mixed yarn can be replaced by polypropylene, polyacrylic, aramide and polyamide fibers. It is also possible to add to the mixed yarn metal fibers so that the yarn acquires antistatic properties. A portion of the mixed yarn metal fibers in the composition may be from 1 to 5% by weight.

If high antistic suitability must be achieved, it is appropriate not to use metal fibers in the mixed yarn but instead to weave a separate metal wire into the covering fabric.

Figure 3:
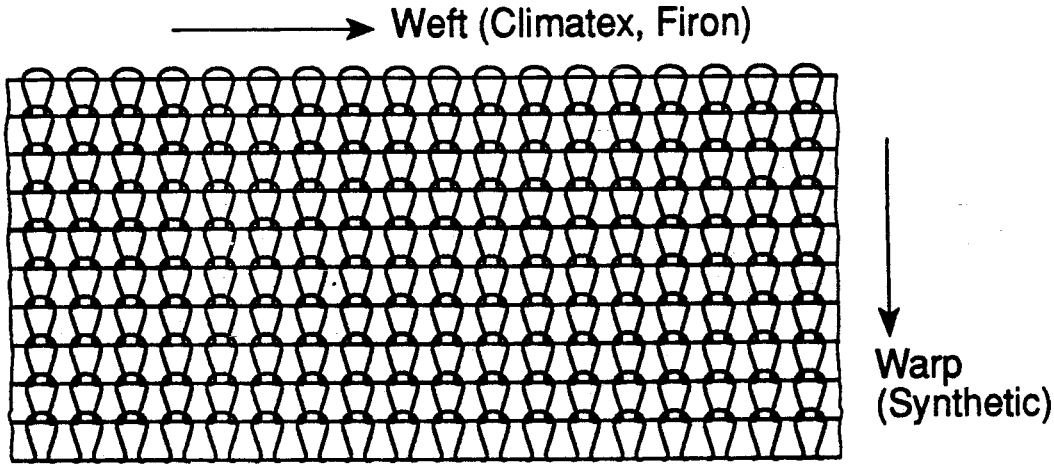
FIG. 3 shows a Knit design of the substrate according to the invention.
Figure 4:
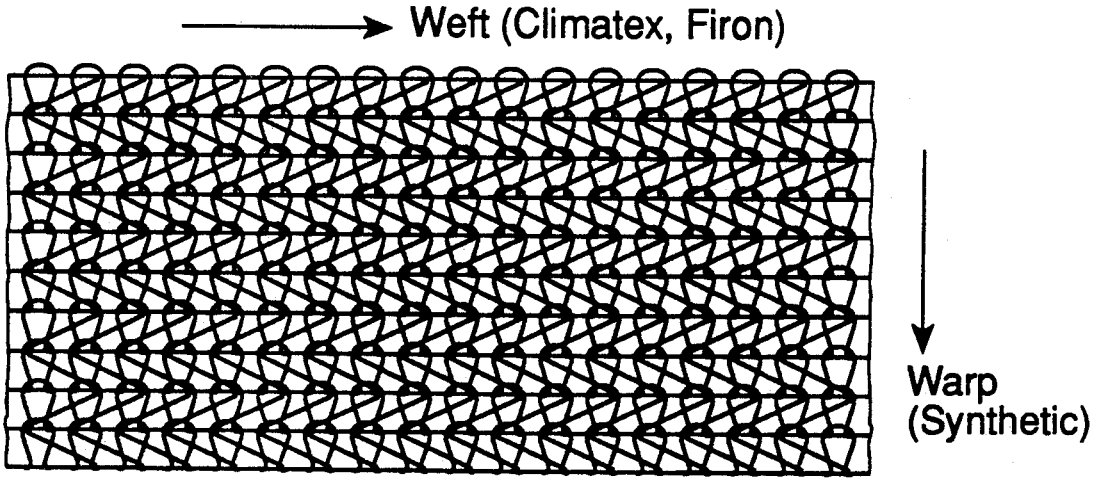
FIG. 4 shows a Malimo design of the substrate according to the invention.

The substrate can be constructed as a woven fabric, but also as Raschel (FIG. 3) or Malimo (FIG. 4). The mixed yarn can be used both as the weft and the warp threads. If it is used as the weft, the warp can be a synthetic yarn. However, if the mixed yarn is used as the warp thread, the weft comprises a synthetic yarn. However, it is also possible to use a mixed yarn for both the weft and warp threads for such coverings. In this case synthetic fibers of the aforementioned type are added to the mixed yarn, so that the aforementioned percentages are achieved.

Covering materials give a high sitting comfort if both the weft and the warp threads are made from the mixed yarn. As a result of the high tear resistance of ramie and polyester fibers, the abrasion resistance of such a material is comparable with that made from synthetics only. Covering materials in which the weft and/or warp threads are made from the described mixed yarns, can also be provided with a fire-retarding finish, without influencing the sitting comfort, i.e., the moisture transport through the fabric.

The weave of the fabric has only a limited influence on the moisture transport. Yarns with counts Nm 10/2–42/2 are appropriately used for the mixed yarn.

EXAMPLE

As an example, a substrate in accordance with the invention that yielded particularly favorable results is described as follows:

The substrate is a fabric made of 42% in weight of wool, 10% in weight of ramie fiber and 48% in weight of polyester, the warp threads consisting exclusively of polyester, the weft threads being mixed yarn of wool and ramie fiber.

The determination of the absorbing speed yielded the following results which are even better than the values for substrates with an appreciably lower quantity of polyester:

| Capillary rise of water | warp | weft |
|---|---|---|
| after 1 hour | 21.3 cm | 15.5 cm |
| after 3 hours | >25.0 cm | 19.2 cm |

While particular embodiments of the present invention have been shown as described, it will be obvious to those skilled in the art that changes and modifications may be made without departing from the invention in its broader aspects. Therefore, the aim in the appended claims is to cover all changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A textile substrate for seat covers containing at least 40% in weight of wool, at least 5% in weight of ramie and fibers of synthetic material, characterized in that the relative content of natural fibers is between 45 and 65% in weight.

2. A textile substrate according to claim 1 characterized in that said textile substrate is a woven or knit fabric.

3. A textile substrate according to claim 2 characterized in that said textile substrate is weft knit fabric.

4. A textile substrate according to claim 2 characterized in that said substrate comprises weft and warp threads, the weft threads consisting of synthetic fibers and the warp threads consisting of natural fibers.

5. A textile substrate according to claim 1 characterized in that it is a Malimo fabric.

6. A textile substrate according to claim 1 characterized in that at least one of the synthetic fibers is selected from the group consisting of polyester, polypropylene, polyamide, polyacrylic, and aramide.

7. A textile substrate for seat covers comprising yarn, containing at least 40% in weight of wool, at least 5% in weight of ramie and fibers of synthetic material, wherein the relative content of natural fibers is between 45 and 65% in weight.

8. A textile substrate according to claim 7 characterized in that the yarn containing wool also contains ramie.

9. A textile substrate for seat covers according to claim 7, having warp and weft threads.

10. A textile substrate according to claim 9 characterized in that the warp threads consist of synthetic fibers and the weft threads consist of natural fibers.

11. A textile substrate according to claim 9 characterized in that warp and weft contain both yarn of natural fibers and yarn of synthetic fibers.

* * * * *